US006168029B1

(12) United States Patent
Henderson et al.

(10) Patent No.: US 6,168,029 B1
(45) Date of Patent: Jan. 2, 2001

(54) METHOD FOR SEPARATING ELECTRICALLY CONDUCTIVE MINERAL COMPONENTS FROM ELECTRICALLY NON-CONDUCTIVE MINERAL COMPONENTS OF AN ORE

(75) Inventors: Raymond Leslie Henderson, Waikiki; Graeme Allan, Mullaloo, both of (AU)

(73) Assignee: Nalco Chemical Company, Naperville, IL (US)

( * ) Notice: Under 35 U.S.C. 154(b), the term of this patent shall be extended for 0 days.

(21) Appl. No.: 09/310,262

(22) Filed: May 12, 1999

(51) Int. Cl.[7] ..... B03B 1/00

(52) U.S. Cl. ..... 209/3; 209/127.1; 209/127.2; 209/127.4; 209/128; 209/129; 209/130; 209/131; 209/11

(58) Field of Search ..... 209/127.1, 11, 209/127.2, 127.4, 128, 129, 130, 131, 3

(56) References Cited

PUBLICATIONS

Chemical Abstracts 80:61592, Composition and enrichability of sands from a placer deposit in Kazakhstan. Dolomanova, M. G.; Komarov, O. K.; Anikeeva, V.I.; Gubanova, T. L. (USSR). Nauch. Tr., Gos. Nauch.–Issled. Proekt. Inst. Redkmetal. Prom., 25, 257–70 (Russian) 1971.

Chemical Abstracts 90:41747, Separation techniques suitable for beach sands of Quinlon. Grover, A. R.; Kulpati, S. D. (India). Plant Maint. Import Substitution, 11(1), 14–19 (English) 1978.

*Primary Examiner*—Donald P. Walsh
*Assistant Examiner*—Jonathan R. Miller
(74) *Attorney, Agent, or Firm*—Kelly L. Cummings; Thomas M. Breininger

(57) ABSTRACT

An improved method for separating electrically conductive components of an ore or mineral sand from electrically non-conductive components of the ore or mineral sand is disclosed which includes processing the ore, adding a polymer, such as an anionic polymer, to the processed ore, drying the polymer and ore, and then feeding the ore and polymer through an electrostatic separator. The addition of the anionic polymer to the processed ore increases the efficiency of the electrostatic separation process.

23 Claims, 1 Drawing Sheet

METHOD FOR SEPARATING ELECTRICALLY CONDUCTIVE MINERAL COMPONENTS FROM ELECTRICALLY NON-CONDUCTIVE MINERAL COMPONENTS OF AN ORE

BACKGROUND OF THE INVENTION

1. Field of the Invention:

The present invention relates generally to mineral processing and refining and, more specifically, the present invention relates to methods for separating certain mineral components of an ore from other mineral components of the same ore. Still more specifically, the present invention relates to methods for separating mineral components of an ore utilizing electrostatic separators. Still more specifically, the present invention relates generally to methods for separating conductive components of an ore from non-conductive components of an ore with electrostatic separators.

2. Description of the prior art

The processing and refining of many types of mineral ore, including mineral sands, generally involves the separation of certain mineral components from other mineral components. For example, a single ore or mineral sand may typically include both rutile and zircon. Both of these minerals have independent uses and must be separated from one another. Such a mineral sand may also include ilmenite, monazite, quartz, staurolite and leucoxene, which also must be separated from the rutile and zircon. The mining of kaolin also requires that kaolin be separated from other materials such as other clays.

One means for separating mineral components of an ore or mineral sand is to take advantage of the differences in conductivity of two components. For example, zircon is a non-conductive material while rutile is a conductive material. As a result, it is known in the mineral processing and refining art to separate zircon and rutile by passing ground or pulverized ore or mineral sand containing the two components through an electrostatic separator. The electrostatic separator applies a voltage across the ore which results in the conductive components such as rutile and ilmenite to migrate to one end of the separator and the non-conductive components such as zircon to migrate to an opposing end of the separator. Thus, the stream of ground ore or mineral sand is split into two streams and each stream may be treated separately in a magnetic separator to separate the magnetic components from the non-magnetic components.

While electrostatic separation is an effective process, it is not efficient. Specifically, current efficiencies are limited to about 70 percent. Thus, a 60 ton per hour feed rate, with only a 70 percent efficiency, requires a recirculating load that also equals about 60 tons per hour. As a result, even a 1 percent improvement in efficiency would enable the feed rate to be increased 2 tons per hour or a 3 percent net increase in feed rate.

Further, in the mining of rutile and zircon, it has been estimated that a 5 percent increase in efficiency, from 70 percent to 75 percent, would result in a significant reduction in processing costs.

Therefore, there is a need for an improved method for separating conductive mineral components from non-conductive mineral components of a common ore or mineral sand. Such an improved separation technique would be applicable to the mining of rutile, zircon or any other ore that includes both non-conductive and conductive components having a commercial value. The mining of kaolin is one additional example.

SUMMARY OF THE INVENTION

The present invention satisfies the aforenoted need by providing a method for separating an electrically conductive component of an ore from an electrically non-conductive component of the ore which comprises the steps of providing a supply of the ore comprising at least one non-conductive component and at least one conductive component, processing the ore (by techniques including grinding, wet separation, attritioning, and acid or alkali washing), adding a polymer to the processed ore, drying the polymer and ore, and separating at least some of the conductive components from the non-conductive components by feeding the ore and polymer through an electrostatic separator and collecting at least some of the conductive components from a first end of the electrostatic separator and at least some of the non-conductive components from a second end of the electrostatic separator.

In an embodiment, the polymer is a latex polymer.

In an embodiment, the polymer is a dry polymer.

In an embodiment, the polymer is a flocculant.

In an embodiment, the polymer is a latex flocculent.

In an embodiment, the polymer is a dry flocculant.

In an embodiment, the polymer is an anionic latex copolymer.

In an embodiment, the polymer is an anionic dry copolymer.

In an embodiment, the polymer is an anionic copolymer of acrylic acid and acrylamide.

In an embodiment, the polymer is polyacrylate.

In an embodiment, the polymer has an anionic charge ranging from about 0.5 to about 1.5 meq/g.

In an embodiment, the polymer has an anionic charge ranging from about 10 percent to about 55 percent.

In an embodiment, the polymer has an anionic charge of about 30 percent.

In an embodiment, the step of adding the polymer to the ore further comprises adding the polymer to the ore at a polymer/ore ratio ranging from about 20 grams per ton to about 100 grams per ton.

In an embodiment, the adding step further comprises adding the polymer to the ore while the ore is under a turbulent flow or under turbulent conditions.

In an embodiment, the present invention provides a method for separating rutile from zircon that comprises the steps of providing a supply of an ore comprising rutile and zircon, processing the ore (by techniques including grinding, wet separation, attritioning, and acid or alkali washing), adding an anionically charged polymer to the processed ore, drying the polymer and ore, and separating at least some of the zircon from the rutile by feeding the ore and polymer through an electrostatic separator and collecting at least some of the zircon from a first end of the electrostatic separator and at least some of the rutile from a second end of the electrostatic separator.

In an embodiment, the polymer is a flocculent.

In an embodiment, the polymer has an anionic charge ranging from about 0.5 to 1.5 meq/g.

In an embodiment, the polymer is an anionic copolymer of acrylamide and acrylic acid with an anionic charge of about 30 percent. The residual acrylamide content of the polymer can range from 0 to 1,000 ppm; the gel number can range from 0 to 60; the molecular weight, represented as RSV (dL/g), can range from 28 to 60; the invert viscosity can range from 100 to 600; the minimum invertability can range from 50 percent to 70 percent and the anionic charge can range from about 0.62 to about 1.22 meq/g.

In an embodiment, the polymer is a flocculating, anionic co-polymer or ter-polymer.

In an embodiment, the polymer is added to a heavy mineral concentrate (HMC).

It is therefore an advantage of the present invention to provide improved zircon and rutile product quality.

Another advantage of the present invention is that it increases the zircon and rutile production rates as opposed to conventional methods.

Another advantage of the present invention is that it reduces the loss of zircon or rutile during processing.

Still another advantage of the present invention is that it provides a means for improving efficiencies of electrostatic separation of conductive minerals from non-conductive minerals.

Other objects and advantages of the invention will become apparent upon reading the following detailed description and appended claims, and upon reference to the accompanying drawings.

Figure 1:
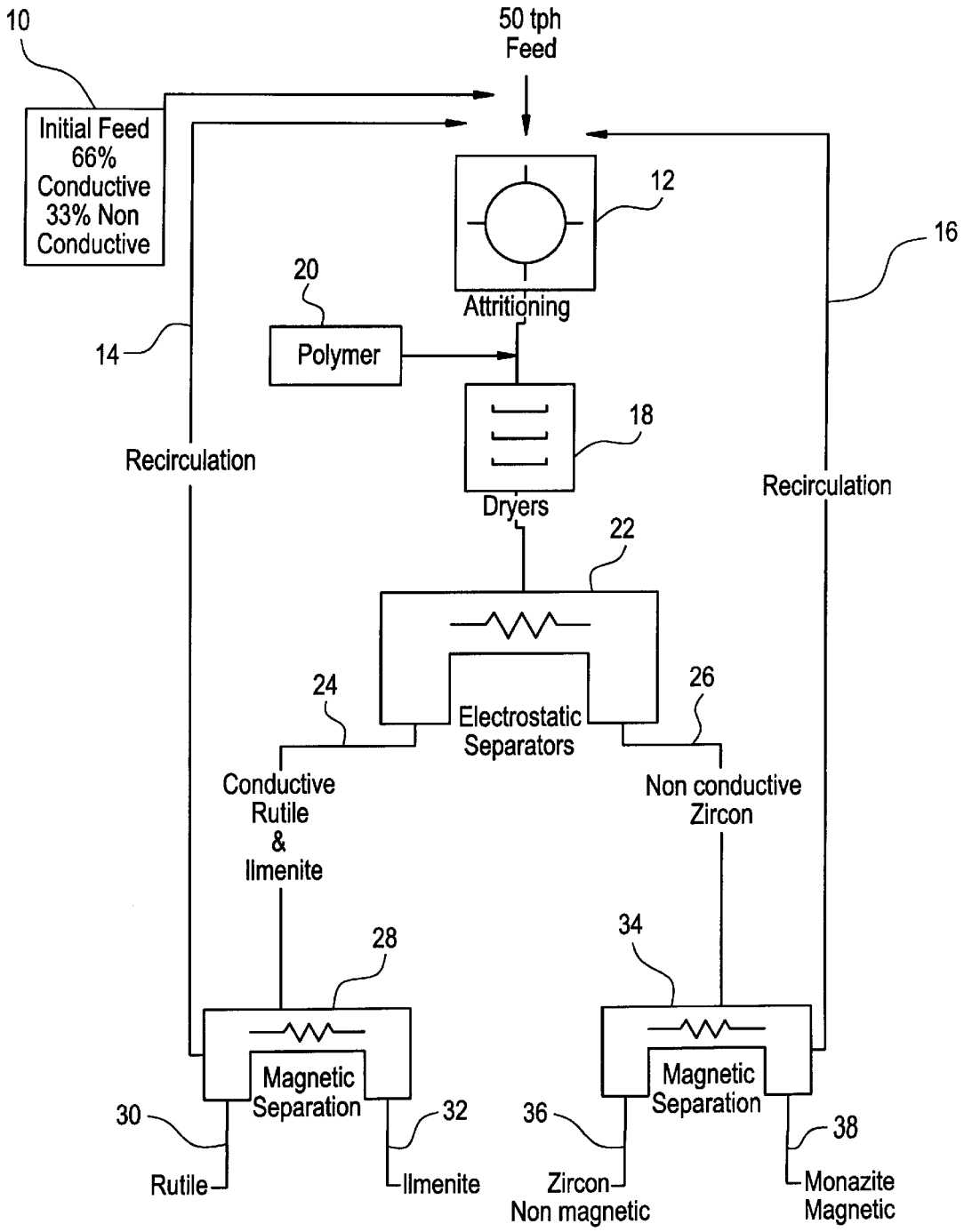
FIG. 1 is a schematic illustration of a mineral sands separation process in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

A process for separating rutile from zircon is illustrated in FIG. 1 by way of example only. It will be noted that the present invention is applicable to other minerals which are separated with electrostatic separators. An initial feed 10 is provided at a rate of about 50 tons per hour to an attritioning stage or grinding mill 12. It will be also noted that recirculation streams 14 and 16 are also fed into the attritioning stage 12. The attritioning stage 12 is typically a wet grinding process. Either during the attritioning or immediately thereafter before the drying stage 18, a polymer is added from a polymer reservoir shown at 20. Preferably, the polymer is added while the ground ore is under a turbulent flow or turbulent conditions. Turbulent flow is preferred to ensure excellent contact and dispersion of the polymer amongst the ground ore. Then the combination of ore and polymer is sent to a dryer 18. After the combination of ore and polymer is dried, the mixture is fed to an electrostatic separator 22 which applies a voltage across the mixture of ore and polymer thereby at least partially separating the conductive rutile and ilmenite components and the non-conductive zircon component into a stream 26. The ilmenite and rutile stream 24 undergoes a magnetic separation at 28 to separate the stream 24 into a rutile rich stream 30 and a ilmenite rich stream 32. The remaining portion of the stream 24 is recycled at 14. Similarly, the stream 26 which is rich in zircon undergoes a magnetic separation at 34 to separate the stream 26 into a zircon rich stream 36 and monozite rich stream 38. The remainder of the stream 26 is recycled at 16.

A variety of polymers were tested for their effectiveness at increasing the separation efficiencies. Dry samples of zircon and rutile were collected from a mine site in Australia and slurried with water containing one of 13 polymer reagents. The excess water was then decanted and the solids dried at 80° C. to 90° C. The dried solids were then submitted to an electrostatic separator under the following conditions: (1) laboratory HTR operating at 260 rpm; (2) voltage at 27 kV; (3) 18 splits to determine separation efficiencies. The results are shown in Table I; the 13 polymers tested are listed in Table II.

Table II summarizes the data collected. It will be noted that sample numbers 3, 10, 19, 23, 24 and 28 produced a 2 percent reduction in cumulative weight percent reporting to splitters 1- 11 and a 5 percent reduction in cumulative weight percent reporting to splitters 1- 18. The results for sample numbers 3, 10, 19, 23, 24 and 28 represent a significant reduction in conductivity which results in an increased zircon split. The polymers utilized in sample numbers 3, 10, 19, 23, 24 and 28 are all copolymers of acrylic acid and acrylamide, specifically polymer numbers 2 and 9, having anionic charges of 30 percent and 25 percent respectively. It is also anticipated that other anionic latex polymers, copolymers and ter-polymers will also prove useful as well.

TABLE I

| | | Aim Rutile Zircon | | | | |
|---|---|---|---|---|---|---|
| | | Increase 1–7 Cumulative % | Reduce 19 Cumulative % | Reduce 1–11 Cumulative % | Reduce 1–18 Cumulative % | |
| Sample No | Polymer No | Conductors Splitter 7 | Nonconductors Splitter 19 | Conductors Splitter 1–11 | Conductors Splitter 1–18 | Treatment (Dosage) |
| 1 | 0 | 1.0 | 58.2 | 22.7 | 41.8 | Blank |
| 2 | 1 | 0.9 | 58.9 | 22.4 | 41.1 | 20 g/t |
| 3 | 2 | 1.0 | 64.5 | 20.4 | 35.6 | 20 g/t |
| 4 | 3 | 1.1 | 59.1 | 22.4 | 40.9 | 20 g/t |
| 5 | 3 | 1.1 | 59.2 | 22.4 | 40.8 | 20 g/t |
| 6 | 4 | 1.2 | 54.6 | 24.2 | 45.4 | 20 g/t |
| 7 | 12 | 1.1 | 48.8 | 25.5 | 51.2 | 500 g/t |
| 8 | 0 | 1.2 | 43.9 | 23.8 | 43.9 | Blank |
| 9 | 0 | 19.1 | 24.5 | 50.0 | 75.5 | Blank |
| 10 | 2 | 18.7 | 30.4 | 48.4 | 69.6 | 20 g/t |
| 11 | 2 | 18.8 | 32.2 | 48.0 | 67.8 | 100 g/t |
| 12 | 2 | 19.2 | 31.9 | 48.2 | 68.1 | 2 g/t polyox + 20 g/t |
| 13 | 0 | 20.0 | 30.3 | 49.3 | 69.7 | Blank |
| 14 | 0 | 37.1 | 4.1 | 67.7 | 95.9 | Blank |
| 15 | 5 | 34.7 | 8.1 | 64.1 | 91.9 | 20 g/t 0% charge |
| 16 | 8 | 35.7 | 6.9 | 65.2 | 93.1 | 20 g/t 20% charge |
| 17 | 7 | 35.2 | 8.6 | 64.3 | 91.4 | 20 g/t 15% charge |
| 18 | 6 | 37.8 | 6.1 | 66.9 | 93.9 | 20 g/t 10% charge |
| 19 | 9 | 34.4 | 11.3 | 62.4 | 88.7 | 20 g/t 25% charge |
| 20 | 10 | 35.6 | 7.9 | 65.0 | 92.1 | 20 g/t 30% charge |
| 21 | 0 | 36.5 | 5.0 | 67.0 | 95.0 | Blank |
| 22 | 0 | | | 19.4 | 36.0 | Blank |
| 23 | 2 | | | 17.7 | 30.9 | 20 g/t |
| 24 | 2 | | | 17.5 | 30.5 | 100 g/t |
| 25 | 12 | | | 18.7 | 34.1 | 20 g/t |
| 26 | 12 | | | 18.4 | 34.2 | 100 g/t |
| 27 | 13 | | | 18.7 | 35.0 | 20 g/t polyox |
| 28 | 2 | | | 17.3 | 30.1 | 20 g/t polyox + 20 g/t |

TABLE I-continued

| | | Aim Rutile Zircon | | | | |
|---|---|---|---|---|---|---|
| | | Increase 1–7 Cumulative % | Reduce 19 Cumulative % | Reduce 1–11 Cumulative % | Reduce 1–18 Cumulative % | |
| Sample No | Polymer No | Conductors Splitter 7 | Nonconductors Splitter 19 | Conductors Splitter 1–11 | Conductors Splitter 1–18 | Treatment (Dosage) |
| 29 | 0 | | | 18.5 | 32.9 | Blank |
| 30 | 0 | 35.3 | 3.4 | | | Blank |
| 31 | 2 | 32.2 | 2.6 | | | 20 g/t |
| 32 | 2 | 32.3 | 2.4 | | | 100 g/t |
| 33 | 12 | 29.2 | 3.6 | | | 20 g/t |
| 34 | 12 | 26.4 | 3.5 | | | 100 g/t |
| 35 | 13 | 32.6 | 2.7 | | | 20 g/t |
| 36 | 13 + 2 | 33.0 | 2.6 | | | 20 g/t polyox + 20 g/t |

TABLE II

| No. | Description | Anionic Charge |
|---|---|---|
| 1 | copolymer of acrylic acid and acrylamide | 10% |
| 2 | copolymer of acrylic acid and acrylamide | 30% |
| 3 | copolymer of acrylic acid and acrylamide | 55% |
| 4 | copolymer of acrylic acid and acrylamide | 98% |
| 5 | copolymer of acrylic acid and acrylamide | 0% |
| 6 | copolymer of acrylic acid and acrylamide | 10% |
| 7 | copolymer of acrylic acid and acrylamide | 15% |
| 8 | copolymer of acrylic acid and acrylamide | 20% |
| 9 | copolymer of acrylic acid and acrylamide | 25% |
| 10 | copolymer of acrylic acid and acrylamide | 30% |
| 11 | low molecular weight polyacrylate | — |
| 12 | epi-dma condensate | — |
| 13 | polyethylene oxide (Union Carbide Polyox WSR 301) | — |

It should be understood that various changes and modifications to the presently preferred embodiments escribed herein will be apparent to those skilled in the art. Such changes and modifications can be made without departing from the spirit and scope of the present invention and without diminishing its attendant advantages. It is therefore intended that such changes and modifications be covered by the appended claims.

What is claimed:

1. A method for separating an electrically conductive component of an ore from an electrically non-conductive component of the ore, the method comprising the following steps:

providing a supply of the ore comprising at least one non-conductive component and at least one conductive component, processing the ore, adding a polymer to the processed ore, drying the polymer and ore, and separating at least some of the conductive component from the non-conductive component by feeding the ore and polymer through an electrostatic separator and collecting at least some of the conductive component from a first end of the electrostatic separator and at least some of the non-conductive component from a second end of the electrostatic separator.

2. The method of claim 1 wherein the processing step is selected from the group consisting of grinding, wet separation, attritioning, acid washing and alkali washing.

3. The method of claim 1 wherein the polymer is a latex polymer.

4. The method of claim 1 wherein the polymer is a dry polymer.

5. The method of claim 1 wherein the polymer is a flocculant.

6. The method of claim 1 wherein the polymer is a latex flocculant.

7. The method of claim 1 wherein the polymer is a dry flocculant.

8. The method of claim 1 wherein the polymer is an anionic latex copolymer.

9. The method of claim 1 wherein the polymer is an anionic dry copolymer.

10. The method of claim 1 wherein the polymer is an anionic copolymer of acrylic acid and acrylamide.

11. The method of claim 10 wherein the polymer has an anionic charge ranging from about 0.5 to about 1.5 meq/g.

12. The method of claim 10 wherein the polymer has an anionic charge ranging from 10% to 55%.

13. The method of claim 1 wherein the polymer is polyacrylate.

14. The method of claim 1 wherein the adding step further comprises adding the polymer to the ore at a polymer/ore ratio ranging from about 20 grams/ton to about 100 grams/ton.

15. The method of claim 1 wherein the adding step further comprises adding the polymer to the ore while the ore is under a turbulent flow.

16. The method of claim 1 wherein the adding step further comprises mixing the polymer with the ore under turbulent conditions.

17. A method for separating rutile from zircon, the method comprising the following steps:

providing a supply of an ore comprising rutile and zircon, processing the ore, adding an anionically charged polymer to the processed ore, drying the polymer and ore, and separating at least some of the zircon from the rutile by feeding the ore and polymer through an electrostatic separator and collecting at least some of the zircon from a first end of the electrostatic separator and at least some of the rutile from a second end of the electrostatic separator.

18. The method of claim 17 wherein the processing step is selected from the group consisting of grinding, wet separation, attritioning, acid washing and alkali washing.

19. The method of claim 17 wherein the polymer is a flocculant.

20. The method of claim 17 wherein the polymer is an anionic copolymer of acrylic acid and acrylamide.

21. The method of claim 20 wherein the polymer has an anionic charge ranging from about 0.5 to about 1.5 meq/g.

22. The method of claim 20 wherein the polymer has an anionic charge of about 30%.

23. The method of claim 17 wherein the adding step further comprises adding the polymer to the ore at a polymer/ore ratio ranging from about 20 grams/ton to about 100 grams/ton.

* * * * *